US007559456B1

(12) United States Patent
McKenzie

(10) Patent No.: US 7,559,456 B1
(45) Date of Patent: Jul. 14, 2009

(54) MAIL DELIVERY INDICATOR SYSTEM

(76) Inventor: Dean McKenzie, 52393 Maple St., Marcellus, MI (US) 49067

( * ) Notice: Subject to any disclaimer, the term of this patent is extended or adjusted under 35 U.S.C. 154(b) by 0 days.

(21) Appl. No.: 12/116,564

(22) Filed: May 7, 2008

(51) Int. Cl.
*A47G 29/12* (2006.01)

(52) U.S. Cl. ..... 232/35

(58) Field of Classification Search ..... 232/35, 232/34, 45, 17; D99/29–32, 43; 116/215
See application file for complete search history.

(56) References Cited

U.S. PATENT DOCUMENTS

| | | | |
|---|---|---|---|
| 2,609,787 | A | 9/1952 | Lawson |
| 2,707,075 | A | 4/1955 | Van Duzer |
| 2,815,167 | A | 12/1957 | Bailes et al. |
| 3,426,966 | A | 2/1969 | Lay |
| 3,547,070 | A | 12/1970 | Schuh |
| 4,138,055 | A | 2/1979 | Harrison |
| D260,313 | S | 8/1981 | Ford et al. |
| D260,319 | S | 8/1981 | Kuntz, Jr. |
| 4,821,953 | A | 4/1989 | Poloha |
| D335,747 | S | 5/1993 | Dearing et al. |
| D341,917 | S | 11/1993 | Meher |
| 5,284,295 | A | 2/1994 | Steinfeldt |
| D356,426 | S | 3/1995 | August |
| D356,428 | S | 3/1995 | Piatkowski et al. |
| 6,053,404 | A | 4/2000 | Jefferson et al. |
| D447,313 | S | 8/2001 | Murawski et al. |
| D457,706 | S | 5/2002 | Teichelman |
| 7,083,080 | B2 | 8/2006 | McKenzie |
| 7,229,004 | B2 | 6/2007 | McKenzie |
| 2001/0000108 | A1 | 4/2001 | Perry |
| 2005/0082358 | A1 | 4/2005 | McKenzie |

*Primary Examiner*—William L. Miller
(74) *Attorney, Agent, or Firm*—Price, Heneveld, Cooper, DeWitt & Litton, LLP

(57) ABSTRACT

A mailbox delivery indicator system (700) for indicating when the mailbox door has been opened includes a signal ball (600) and a signal holder arm (501, 503, 505) extending laterally from the front face of a mailbox door. The signal holder arm (501, 503, 505) includes a ring section (507) for holding the signal ball (600) such that the ring section (507) includes a locking member (513). The locking member (513) extends from an edge of the ring section (507) for engaging with a clevis (603) on the signal ball (600) to hold the signal ball (600) in a fixed position within the ring section (507). The mailbox delivery indicator system (700) works to signal the user that mail has been delivered when the signal ball (600) is disengaged from the locking member (513).

17 Claims, 4 Drawing Sheets

MAIL DELIVERY INDICATOR SYSTEM

FIELD OF THE INVENTION

The present invention relates generally to an apparatus that indicates when mail has been delivered to a mailbox and more particularly to a mailbox signal holder bracket and signal ball.

BACKGROUND OF THE INVENTION

Various types of mailbox indicators that indicate when mail has been deposited in a mailbox are well known in the art. These mail indicators can range in complexity from using a very simply ball to those requiring complicated electronic components. One problem associated with many types of mailboxes that use a signaling device is that the signal indicator cannot be locked into a fixed positioned at the mailbox. If a user does not wish to use the indicator or take it from service, there is presently no way to lock the indicator into position.

For example, U.S. Pat. No. Des. 260,319 issued to Kuntz, Jr. on Aug. 18, 1981, outlines the use of an ornamental design for a mailbox signal. In this design, it appears the signal ball fastens to the mailbox door using a dowel or peg that is inserted into the signal ball. Similarly, U.S. Pat. No. 2,609,787 issued to Lawson teaches the use of a dual signaling device to assist in mail collection and delivery. A signaling tag or plate is hung on a hook to hold the tag to the mailbox door. Finally, U.S. Pat. No. 4,821,953 issued to Poloha on Apr. 19, 1989 outlines the use of a mailbox signaling apparatus for use on both rural-type and residential-type mailboxes. The apparatus includes a suspension unit having a support arm and at least one elongated slot and a signal unit including a signal member attached to the suspension unit. The suspension unit includes an attachment ring that is dimensioned to be selectively received over the support arm and within the slot.

Although this prior art may outline the use of novel and useful devices, what is needed is mailbox delivery indicator that can be observed from the front and the back of a mailbox but is versatile allowing it to fixedly attach to the indicator if it is not to be in use.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
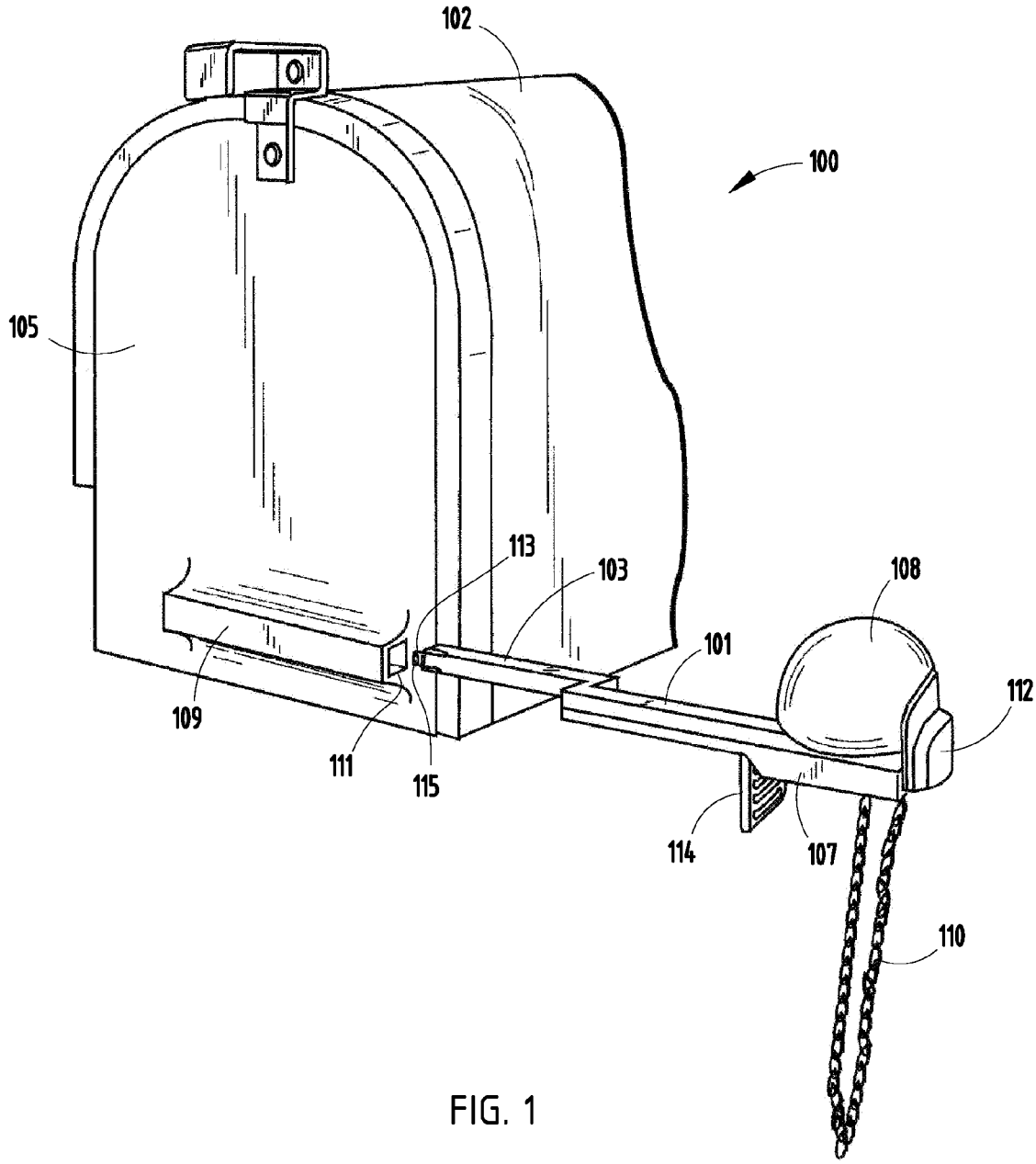
FIG. 1 is a side perspective view of the mail delivery indicator assembly for a mailbox for viewing at the side of the mailbox in accordance with the invention.

FIG. 1 illustrates a mail delivery indicator assembly 100 for use with a mailbox 102. The mail delivery indicator assembly 100 includes a signal holder bracket 101 having an offset section 103 for fastening the signal holder bracket 101 to a mailbox door 105 which may be positioned either flush or recessed into the opening of the box. The offset section 103 provides an angular displacement of the signal holder bracket 101 allowing one end to be fastened to a mailbox door which may be recessed into the open end of the mailbox.

The signal holder bracket 101 further includes a ring section 107 that operates to hold a signal ball 108. A tether line 110 is attached to both the signal ball 108 and the signal holder bracket 101 so as to prevent the signal ball 108 from being lost when hanging outside the ring section 107. The ring section 107 includes a first guard 112 and second guard 114 that work to block objects such as snow that may be propelled by a snow plow and/or other road debris from inadvertently forcing the signal ball 108 from the ring section 107. Those skilled in the art will recognize that the signal ball 108 should only be removed from the ring section 107 when intended and any inadvertent or unintentional removal will provide the user with a false signal that the mailbox door has been opened.

The signal holder bracket 101 is attached to the mailbox door 105 through the use of a holder receptacle 109. The receptacle 109 may be molded into the mailbox door 105 during manufacture or may be fastened separately to a pre-existing door. The receptacle 109 includes an engagement slot 111 that is a cavity within the receptacle 109 that works to accept an open end 113 of the signal holder bracket 101. When inserted into the receptacle 109, the signal holder bracket 101 can be firmly held into position. Thus, in this embodiment, the signal holder bracket 101 is not fixedly attached directly to the mailbox door 105 allowing it to be easily removed for cleaning, maintenance or other purposes.

Figure 2:
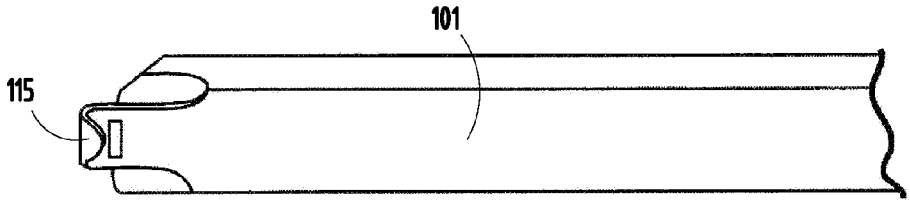
FIG. 2 is a side perspective view of a portion of the mail signal holder bracket.
Figure 3:
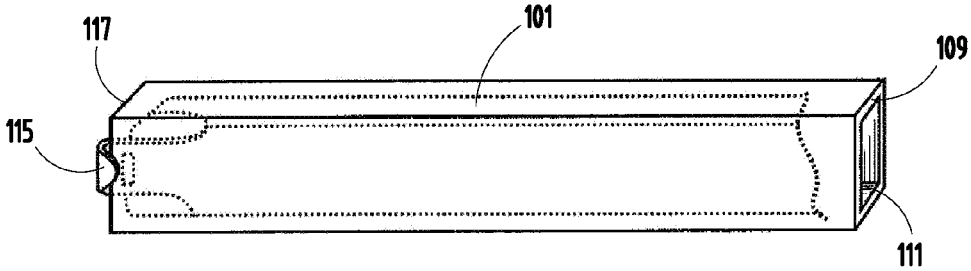
FIG. 3 is a side perspective view of the signal holder bracket inserted into a receptacle attached to the mailbox door.

FIGS. 2 and 3 illustrate closer views of the receptacle 109 as used with the signal holder bracket 101. As seen in FIG. 2, the signal holder bracket 101 further includes a fastener 115 that provides a resilient biasing force to hold the signal holder bracket 101 into the receptacle 109. As will be evident to those skilled in the art, the fastener 115 may be molded into the signal holder bracket 101 and operates such that when the signal holder bracket 101 is inserted into the receptacle 109, the fastener is compressed. As seen in FIG. 3, when the signal holder bracket 101 is fully inserted into the receptacle 109, the fastener 115 provides a biasing force by engaging and/or latching with the back end 117 of the receptacle 109. When the fastener 115 is fully inserted within the receptacle 109, the biasing force moves the fastener 115 allowing it to engage with an edge of the receptacle 109. This allows the signal holder bracket 101 to be held into a rigid position despite any application of longitudinal force that would allow the signal holder bracket 101 to be pulled from the receptacle 109. To unlatch and remove the signal holder bracket 101, the fastener 115 may be compressed by squeezing the fastener 115 so that it disengages from the back end 117. This allows the bracket to be retracted from the receptacle 109. In an optional embodiment, the fastener 115 may be engaged within a locking hole (not shown) so as to securely hold it into position.

Figure 4:
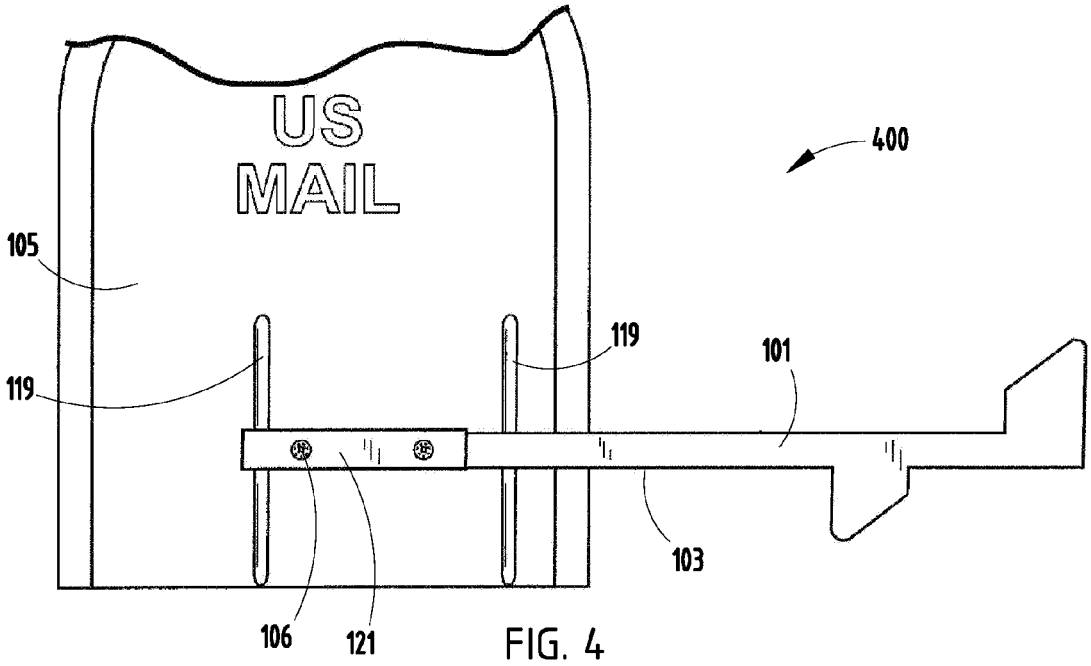
FIG. 4 is an alternative embodiment to the invention shown in FIG. 1 illustrating a side view of a signal holder bracket that is fixedly attached to a mailbox door.

FIG. 4 illustrates a side view of an alternative embodiment to that shown in FIG. 1 where the signal holder bracket assembly 400 includes an arm or bracket 101 that is fixedly attached to the mailbox door 105. The signal holder bracket 101 includes a plurality of guides 119 which operate to allow the user to attach the signal holder bracket 101 to the mailbox door 105 in a pre-determined location. In operation, the user can position the signal holder bracket 101 on either side of the mailbox door. The guides 119 provide a reference to position the mounting section 121 of the bracket in the correct location on the surface of the mailbox door 105. If used on a recessed door, the position of the mounting section 121 is critical in order to allow the offset section 103 to operate properly. The guides 119 are attached to the signal holder bracket 101 such that they can be easily removed. Thus, the guides allow the user to quickly attach the mounting section 121 at the proper position eliminating guesswork and trial and error methods of attachment. Once positioned, an adhesive (not shown) or other mechanical fastener may be used to securely attach the mounting section 121 at one or more mounting locations 106 to the mailbox door 105. Those skilled in the art will recognize that the mounting locations 106 may be screw holes or slots enabling the user to install the signal holder bracket 101 in the desired position.

Figure 5:
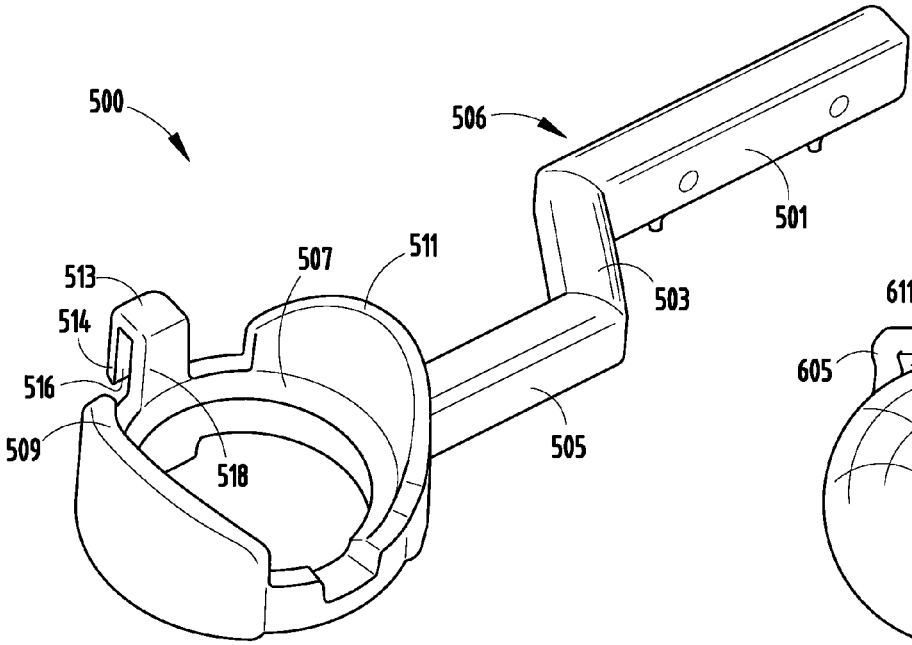
FIG. 5 is a side perspective view of an alternative embodiment of the mail signal holder bracket that includes a hook for fastening the signal ball.

FIG. 5 illustrates a side perspective view of an alternative embodiment of the invention. In this alternative embodiment, the signal holder bracket 500 includes a first attachment section 501, an offset section 503, and a second attachment section 505 all joined to form an arm or attachment member 506. A ring section 507 is attached to the second attachment section 505 that forms the base for holding a signal ball. Attached to the ring section 507 are a first guard 509 and a second guard 511 that form a wall and/or barrier for preventing plowed snow or other material from jarring a ball while seated in the ring section 507. A locking section 513 is further positioned on the upper perimeter of the ring section 507 that engages with a signal ball as described hereinafter. The locking section 513 includes a flanged end 514 positioned such that a gap 516 is formed between the flanged end 514 and wall member 518.

Figure 6:
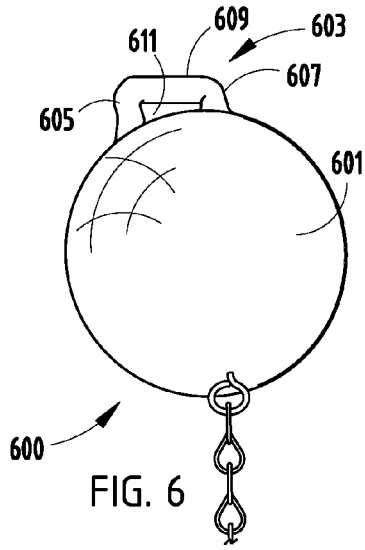
FIG. 6 is a side perspective view of an alternative embodiment of the signal ball used in combination with the mail signal holder bracket shown in FIG. 5.

FIG. 6 is a side perspective view of an alternative embodiment of the signal ball 600 used in combination with the mail signal holder bracket shown in FIG. 5. The signal ball 600 includes a substantially spherical surface 601 and a clevis 603 which protrudes from the surface 601. The clevis 603 is substantially rectangular in shape and includes a first brace section 605 and second brace section 607 and top brace section 609. A cavity 611 is used to engage a corresponding portion of the locking section 513 as seen in FIG. 5.

Figure 7:
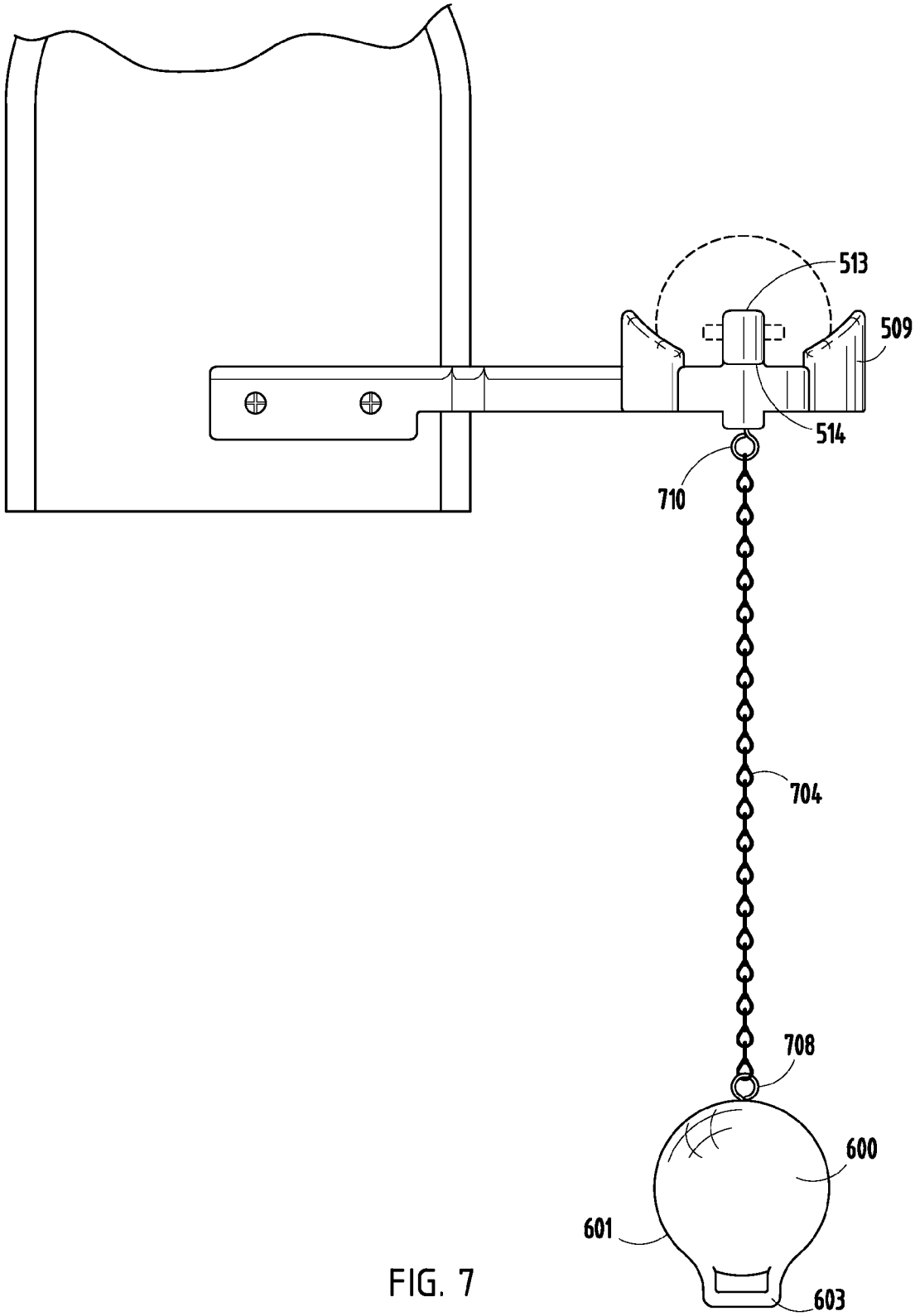
FIG. 7 is a side perspective view of the signal ball positioned below the signal holder bracket.

FIG. 7 is a side perspective view of the signal ball positioned below the signal holder bracket 500. The signal ball 600 includes a substantially spherical surface 601. A chain 704 is attached to the signal ball 600 and ring section 507 through a fasteners 708, and fastener 710 respectively. As noted in FIG. 6, the signal ball 600 includes a clevis 603 that is used to engage the signal ball 600 to a locking section 513. In order to engage the clevis 603 with the locking section 513, the signal ball 600 is oriented in a manner so as to move the clevis 603 on top of and over a flanged end 514. The clevis 603 is positioned under the gap behind the flanged end 514 such that the signal ball 600 is rotated and is seated in the ring section 507. Once engaged, the flanged end 514 operates to prevent the clevis 603 from easily moving back across and disengaging from the locking member 513. As seen in FIG. 7, the signal ball 600 and clevis 603 are also shown in phantom seated in the ring section 507.

Figure 8:
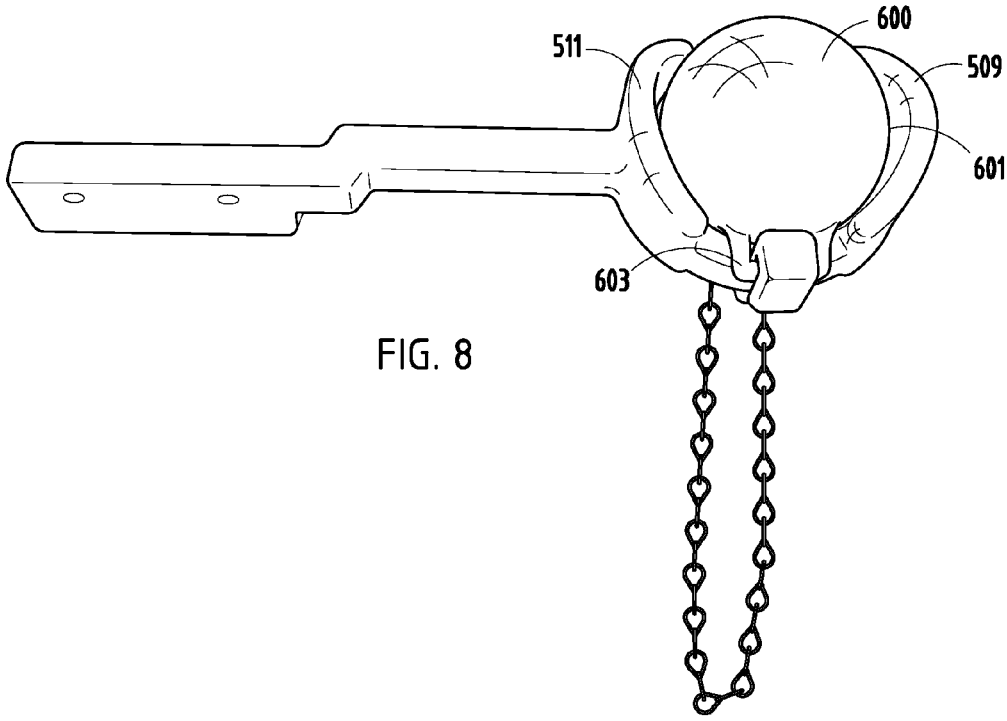
FIG. 8 is a top perspective view of the signal ball fastened within the ring section.

FIG. 8 is a top perspective view of the signal ball fastened within the ring section 507. The signal ball 600 is shown seated in the ring section 507 such the clevis 603 is engaged with the locking member 513. This acts to hold the signal ball 600 into a fixed position within the ring section 507 when the user does not wish the signal ball to be moved.

Thus, an embodiment of the present invention is a mail delivery indicator for a mailbox with a door that includes a signal holder bracket attached to a mailbox door. The signal holder bracket assembly includes a signal holder arm extending perpendicularly from the face of the mailbox door. At an opposite end of the signal holder bracket a ring section is then used for holding a signal ball. The ring section includes a locking section that is engaged with a clevis on the signal ball to hold the ball into a fix position within the ring section.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims. As used herein, the terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article or apparatus.

I claim:

1. A mailbox delivery indicator system for indicating when a mailbox door has been opened comprising: a signal ball; a signal holder arm extending laterally from the front face of the mailbox door, the signal holder arm includes a ring section for holding the signal ball; and wherein the ring section includes a locking member extending from an edge of the ring section which engages with a clevis on the signal ball to hold the signal ball in a fixed position within the ring section; and wherein the ring section includes a tether for fastening to the signal ball.

2. A mailbox delivery indicator system as in claim 1, wherein the locking member extends above the ring section.

3. A mailbox delivery indicator system as in claim 1, wherein the signal holder arm includes an offset section for angularly displacing an end of the signal holder arm opposite to that of the mailbox door.

4. A mailbox delivery indicator system as in claim 1, wherein the ring section includes a guard positioned around an inner portion of the ring section for blocking objects from accidentally removing the signal ball.

5. A mailbox delivery indicator system as in claim 1, wherein the ring section includes a guard positioned around an outer portion of the ring section for blocking objects from accidentally removing the signal ball.

6. A mailbox delivery indicator system as in claim 1, wherein the clevis forms a substantially square loop.

7. A mailbox bracket assembly for attachment to a mailbox door for providing a visual signal when the mailbox door has been opened comprising: a signal ball having a clevis; a signal holder arm mounted to the mailbox door and extending laterally therefrom, the signal holder arm including a ring section for holding the signal ball therein; at least one guard section extending around the ring section for blocking objects from inadvertently contacting the signal ball; and at least one locking member extending from the ring section for engaging with the clevis for holding the signal ball into a fixed position within the ring section; and wherein the ring section includes a tether for fastening to the signal ball.

8. A mailbox bracket assembly as in claim 7, wherein the signal holder arm includes an offset for displacing an end of the signal holder arm.

9. A mailbox bracket assembly as in claim 7, wherein the at least one guard section includes an upper guard and a lower guard.

10. A mailbox bracket assembly as in claim 9, wherein the upper guard extends around an outer edge of the ring section.

11. A mailbox bracket assembly as in claim 10, wherein the lower guard extends around an inner edge of the ring section.

12. A mailbox bracket assembly as in claim 7, wherein the at least one locking member extends above the ring section.

13. A mailbox bracket signaling system for a mailbox door comprising: a signal ball having a clevis extending from its surface; a signal holder arm attached to the mailbox door, the signal holder arm includes an offset section; a ring section attached to the signal holder arm for holding the signal ball in a fixed position therein; a locking member extending from and above the ring section; and wherein the locking member engages with the clevis for holding the signal ball in the fixed position within the ring section; and wherein a chain attaches between the ring section and the signal ball.

14. A mailbox bracket signaling system as in claim 13, wherein the clevis is substantially square in shape.

15. A mailbox bracket signaling system as in claim 13, wherein the ring section includes at least one guard for blocking objects from inadvertently removing the signal ball from the ring section.

16. A mailbox bracket signaling system as in claim 15, wherein the at least one guard includes an upper guard extending around an outer portion of the ring section and a lower guard extending around an inner portion of the ring section.

17. A mailbox bracket signaling system as in claim 13, wherein locking member includes a flanged end for preventing the locking member from sliding through the clevis.

* * * * *